US009330620B2

(12) United States Patent
Chang

(10) Patent No.: US 9,330,620 B2
(45) Date of Patent: May 3, 2016

(54) DRIVING METHOD OF FIELD SEQUENTIAL DISPLAY

(75) Inventor: Pao-Shu Chang, Hsinchu (TW)

(73) Assignee: Nuvoton Technology Corporation, Hsinchu (TW)

( * ) Notice: Subject to any disclaimer, the term of this patent is extended or adjusted under 35 U.S.C. 154(b) by 1771 days.

(21) Appl. No.: 12/629,054

(22) Filed: Dec. 2, 2009

(65) Prior Publication Data

US 2010/0265218 A1 Oct. 21, 2010

(30) Foreign Application Priority Data

Apr. 20, 2009 (TW) ..... 98113010 A

(51) Int. Cl.
*G09G 5/00* (2006.01)
*G09G 3/36* (2006.01)

(52) U.S. Cl.
CPC ..... *G09G 3/3648* (2013.01); *G09G 2310/0235* (2013.01); *G09G 2310/0283* (2013.01); *G09G 2310/067* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 7,227,521 | B2 * | 6/2007 | Yamazaki et al. | 345/84 |
| 7,483,013 | B2 | 1/2009 | Osame | |
| 2005/0225545 | A1 | 10/2005 | Takatori et al. | |
| 2007/0063959 | A1 * | 3/2007 | Iwabuchi et al. | 345/100 |

* cited by examiner

*Primary Examiner* — K. Wong
(74) *Attorney, Agent, or Firm* — Jianq Chyun IP Office

(57) ABSTRACT

A driving method of a field sequential display apparatus is provided. First, a plurality of scan lines of the field sequential display apparatus are sequentially driven according to a scanning sequence in a first period of a first field, wherein the first field is in a first frame. Next, the scan lines are sequentially driven according to an opposite sequence in a second period of the first field, wherein the opposite sequence is in the reverse order of the scanning sequence. Finally, the scan lines are simultaneously driven or not driven in a third period of the first field. Consequently, the disclosed driving method can promote the uniformity of the image brightness.

16 Claims, 5 Drawing Sheets

DRIVING METHOD OF FIELD SEQUENTIAL DISPLAY

CROSS-REFERENCE TO RELATED APPLICATION

This application claims the priority benefit of Taiwan application serial no. 98113010, filed Apr. 20, 2009. The entirety of the above-mentioned patent application is hereby incorporated by reference herein and made a part of specification.

BACKGROUND OF THE INVENTION

1. Field of the Invention

The present invention generally relates to a technology of a flat panel display; more specifically, to a method of driving a field sequential display apparatus.

2. Description of Related Art

In conventional liquid crystal displays, the light source designs of backlight modules usually do not venture far from white light sources (usually white light emanating from cold cathode tubes). The white light usually passes through color filters to form the backlight source needed for each of the pixels. From the perspective of an array of pixels, there is a red color filter, a green color filter, and a blue color filter above each pixel. This arrangement not only results in high production costs, but also gives rise to color deviation problems at the adjacent boundaries of each of the red, green, and blue color filters. In addition, since liquid crystal displays are manufactured with color filter structure, the white light sources experience brightness degradation due to light blockage at the color filters.

In view of the above problems, the color sequential display, which has complementary circuitry based on the Color Sequential Method, is developed. This type of display is also called the field sequential display because color fields are alternately displayed. The field sequential display uses various color light-emitting diodes (LEDs) to replace the conventional white light source. Color of each pixel is displayed by alternately lighting one of the color light sources according to the timing control. The corresponding theory is that in the short span of human visual retention, the rapidly switched red, green, and blue colors on the time axis mix to produce a color mixing effect. Consequently, the human eye experiences full color images.

FIG. 1A is a schematic view illustrating the driving waveform of a conventional field sequential display. As shown in FIG. 1A, a full frame includes a red, green, and blue fields. In the red field, red LEDs are lit to provide red backlights. During the T1 period, the field sequential display sequentially drives scan lines $SL_1$~$SL_n$ and writes the corresponding pixel data into each pixel. In addition, to avoid conflicts of the pixel data written by the red field with the next field (e.g. the green field), scan lines $SL_1$~$SL_n$ are simultaneously driven during the period T2, and the reset pixel data is written (e.g. black pixel data). In the green field and the blue field, green LEDs and blue LEDs are lit to provide green and blue backlights. The driving scheme of the scan lines $SL_1$~$SL_n$ in the green and blue fields is the same as the driving scheme of the scan lines $SL_1$~$SL_n$ in the red field. Nevertheless, the aforementioned driving method is a sequential driving scheme and coupled with the response times is needed for liquid crystal pixel light transmissions, therefore, the above-mentioned driving method results in lower light transmission quantity at the scan line $SL_n$ than at the scan line $SL_1$. Consequently, the brightness of the displayed image brightness is not uniform.

A method to solve the problem aforementioned is disclosed in U.S. Pub. No. 2005/0225545A1, in which a liquid crystal display apparatus and its corresponding driving method are described. FIG. 1B is a driving waveform illustrating the driving scheme of the liquid crystal display apparatus found in U.S. Pub. No. 2005/0225545A1. As shown in FIG. 1B, in this disclosure, each field is separated into two sub-fields. Each of the sub-fields includes a write period 101, a display period 102, and a reset period 103. For the red field, the write period 101 of the first sub-field appears in each scan line to write pixel data in each pixel. The display period 102 appears after the pixel data is written in the last scan line for display. Although this driving scheme improves the uniformity of image brightness, there are still variations between the brightness of each scan line. In the reset period 103, each pixel is reset, avoiding conflicts of the pixel data written in this sub-field with the next sub-field.

In the second sub-field of the red field, the appearance order of the write period 101 is reversed compared to the order in the first sub-field. This driving scheme produces higher pixel brightness at the last scan line than the pixel brightness at the first scan line. The brightness displayed by pixels on each scan line is more uniform due to the write periods appearing in reverse order between the red field's first sub-field and second sub-field. The driving waveforms for the green field and the blue field are equivalent to those of the red field, and so descriptions can be referenced to the above.

Nevertheless, because two reset periods 103 appears in the same field, and the last scan line on which pixel data is written in has a display period 102, there is a squeezing effect for the write period 101. Consequently, the write period 101 is shortened. Due to current display panels increasing in size, the write period 101 is increasingly shortened. If the driving scheme disclosed in U.S. Pub. No. 2005/0225545 A1 is implemented on large display panels, there can be insufficient time in the write period 101 to accurately write in the pixel data.

SUMMARY OF THE INVENTION

The present invention provides a method of driving a field sequential display apparatus, in which realization of the method improves the uniformity of image brightness and decreases image flickering.

The present invention provides a method of driving a field sequential display apparatus. In the method, during a first period of a first field, a plurality of scan lines of the field sequential display apparatus is sequentially driven according to a scanning sequence, wherein the first field is within a first frame. Next, during a second period of the first field, the scan lines are sequentially driven according to an opposite sequence. The opposite sequence is in the reverse order of the scanning sequence. Finally, during a third period of the first field, the scan lines are simultaneously driven.

In one embodiment of the present invention, the aforementioned driving method further comprises: driving the scan lines sequentially during a fourth period of a second field according to the opposite sequence, wherein the second field is within a second frame; driving the scan lines sequentially during a fifth period of the second field according to the scanning sequence; and driving the scan lines simultaneously during a sixth period of the second field.

The present invention further provides a method of driving a field sequential display apparatus. First, during a first period of a first field, scan lines of the field sequential display apparatus are sequentially driven according to a scanning sequence, wherein the first field is within a first frame. Next, during a second period of the first field, the scan lines are sequentially driven according to an opposite sequence. The opposite sequence is in the reverse order of the scanning sequence. Finally, during a third period of the first field, the driving of the scan lines is terminated.

In one embodiment of the present invention, the aforementioned driving method further comprises: driving the scan lines sequentially during a fourth period of a second field according to the opposite sequence, wherein the second field is within a second frame; driving the scan lines sequentially during a fifth period of the second field according to the scanning sequence; and terminating the driving of the scan lines during a sixth period of the second field.

In one embodiment of the present invention, the aforementioned first field and second field are a red field, a green field, or a blue field.

In one embodiment of the present invention, the aforementioned first frame and second frame are respectively an odd frame and an even frame.

In one embodiment of the present invention, the aforementioned first and second periods are equivalent.

In one embodiment of the present invention, within the first field the time of driving each of the aforementioned scan lines is equivalent.

In one embodiment of the present invention, the time in the aforementioned third and sixth periods is zero.

In one embodiment of the present invention, the aforementioned scan lines correspond to a plurality of pixels. During the third period and during the sixth period, there is zero voltage difference between an upper electrode plate and a lower electrode plate of each of the pixels.

Based on the above, in the method of driving a field sequential display apparatus disclosed in the present invention, pixel data is written into each pixel by sequentially driving the scan lines in the first field and the second field according to the scanning sequence or the opposite sequence, wherein the opposite sequence is in the reverse order of the scanning sequence. Hence, the uniformity of image brightness in each field is improved. In addition, because the driving schemes of the scan lines in the first frame and in the second frame are reversed, the image brightness is made more uniform for the field sequential display apparatus. Meanwhile, since driving speed is increased and the human eye detects less image flickers, therefore image flickering is reduced.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
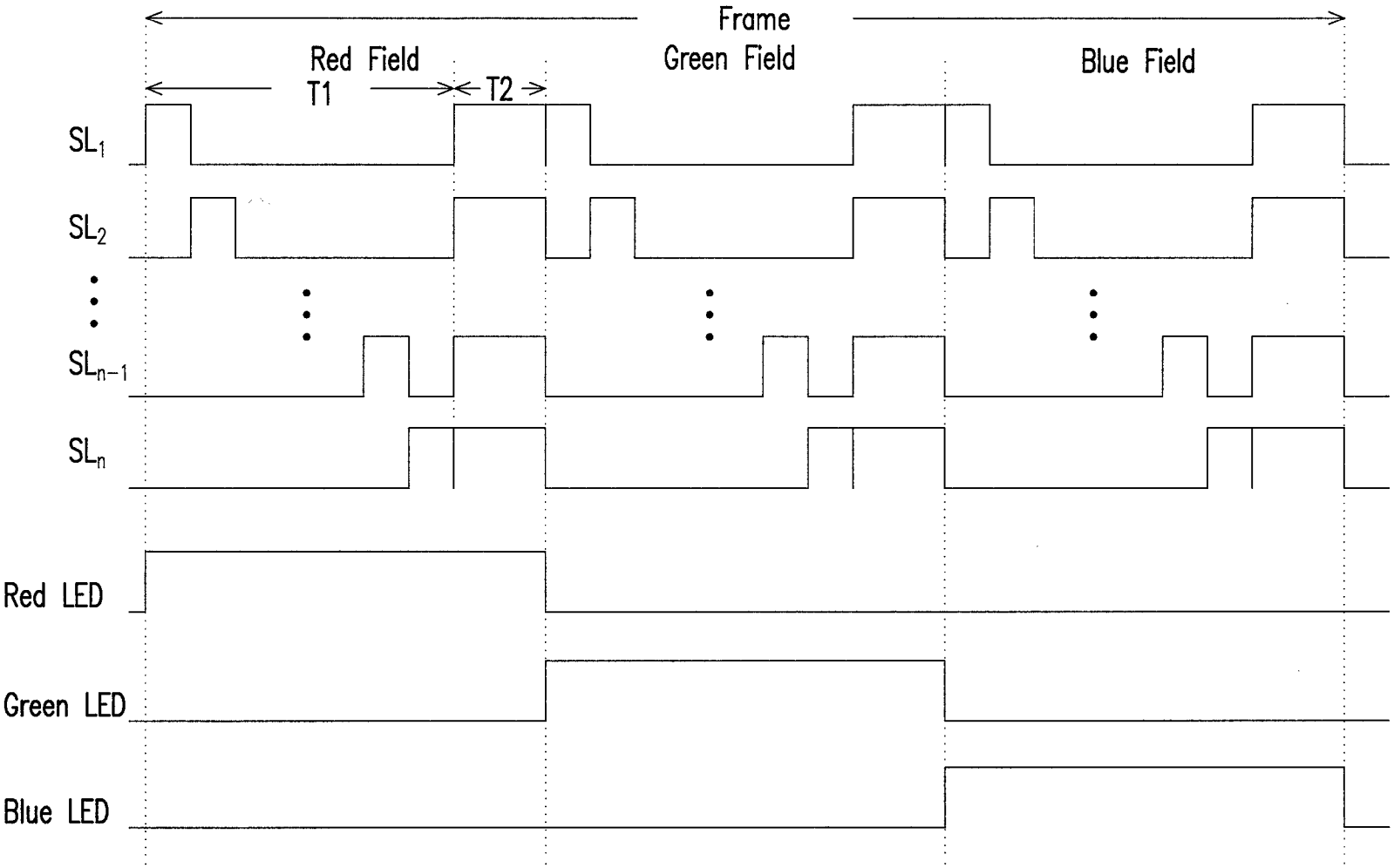
FIG. 1A (PRIOR ART)
FIG. 1A is a schematic view illustrating the driving waveform of a conventional field sequential display.
Figure 1B:
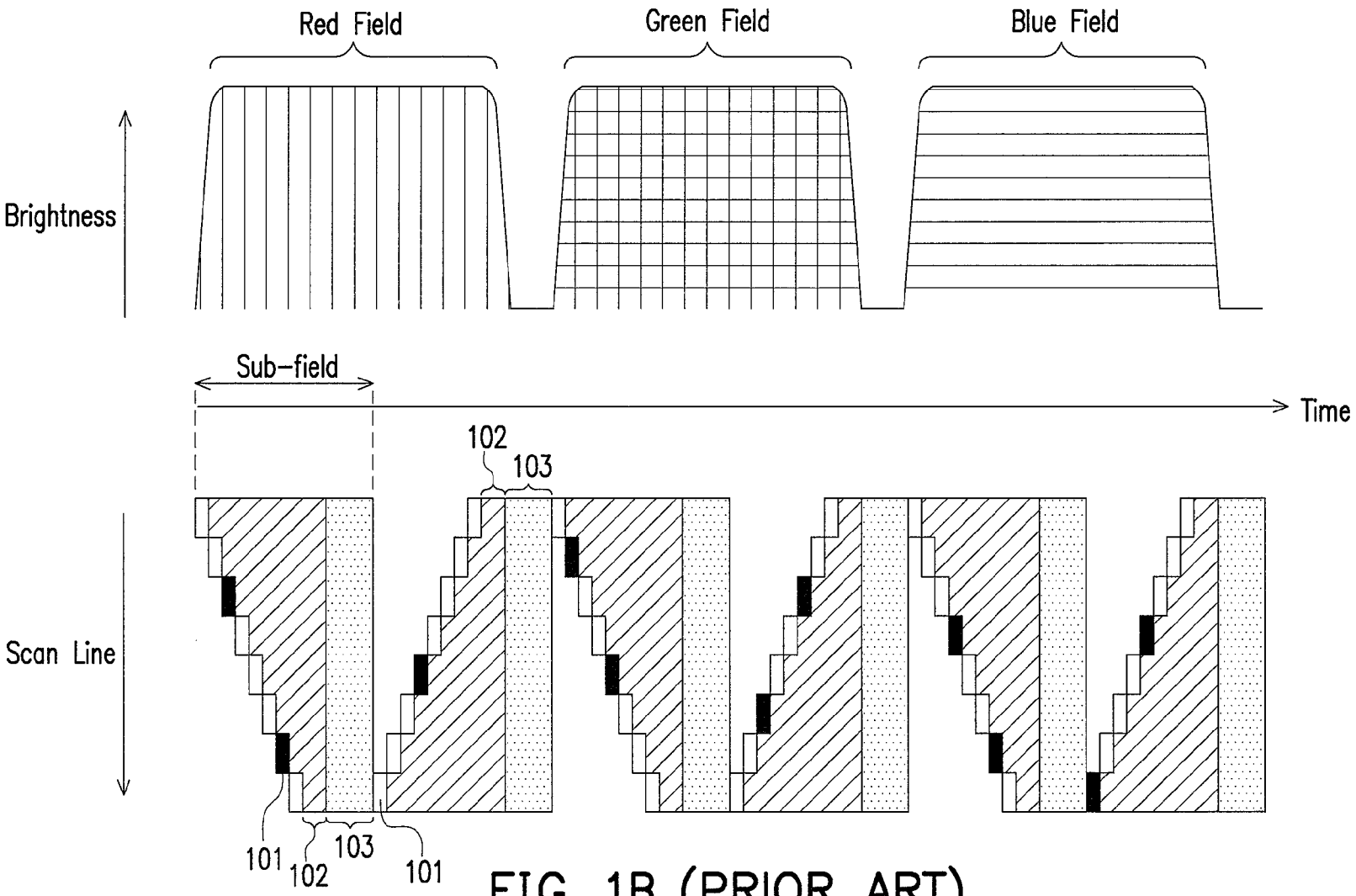
FIG. 1B (PRIOR ART)
FIG. 1B is a driving waveform illustrating the driving method of a liquid crystal display found in U.S. Pub. No. 2005/0225545A1.
Figure 2:
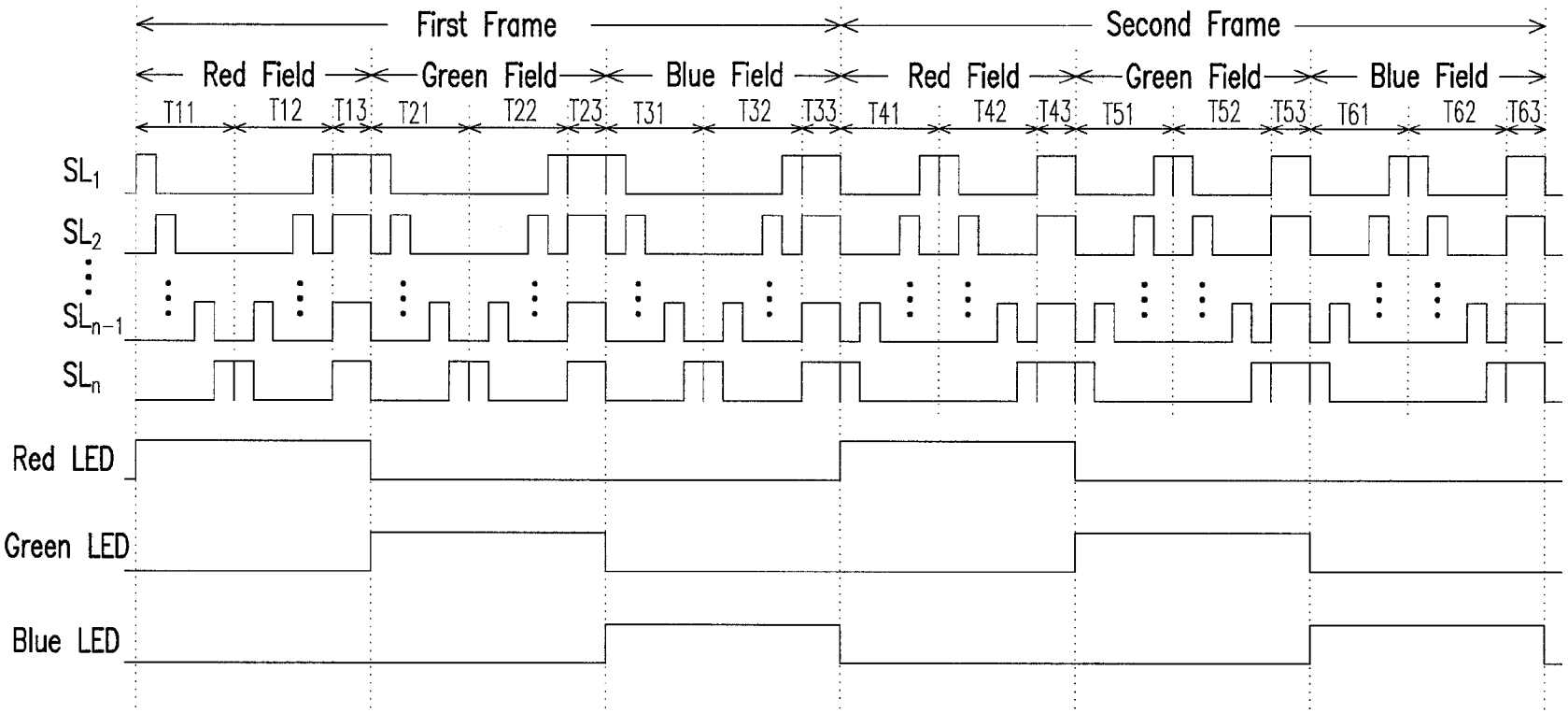
FIG. 2 is a schematic view illustrating the driving waveform of a field sequential display apparatus according to one embodiment of the present invention.

FIG. 2 is a schematic view illustrating the driving waveform of a field sequential display apparatus according to one embodiment of the present invention. As shown in FIG. 2, there is a first frame, and within the first frame there is a red field, a green field, and a blue field. The red field (or the first field) will be described first. In the red field, red LEDs are lit to provide red backlights. During period T11 (or the first period), the scan lines $SL_1$ to $SL_n$ are sequentially driven by the field sequential display apparatus according to the scanning sequence. Assuming here that the scanning sequence is from the scan line $SL_1$ to the scan line $SL_n$, then the field sequential display apparatus sequentially drives scan lines $SL_1$ to $SL_n$ in order to write in the corresponding pixel data. This allows the field sequential display apparatus to display images in the red field. Herein, the time of driving the scan lines $SL_1$ to $SL_n$ can be uniform, meaning that the time of driving the scan lines $SL_1$ to $SL_n$ are also equal.

During period T12 (or the second period), the scan lines $SL_1$ to $SL_n$ are sequentially driven by the field sequential display apparatus, according to the opposite sequence. Assuming here that the opposite sequence is in the reverse order of the scanning sequence, then the field sequential display sequentially drives the scan lines $SL_n$ to $SL_1$ in order to write-in the corresponding pixel data. This also allows the field sequential display apparatus to display images in the red field. However, during period T11, the scan lines $SL_1$ to $SL_n$ are sequentially driven whereas during period T12, the scan lines $SL_n$ to $SL_1$ are sequentially driven. What is displayed in the brighter region of the red field versus the darker region is dissimilar, so after image overlapping, there is uniform brightness in what is displayed during period T11 and period T12 in the red field. Furthermore, because driving speed is increased in the red field and the human eye experiences less image flickers, and image flickering in the red field is reduced.

During period T13 (or the third period), in order to write in the reset pixel data (e.g. black pixel data) into all of the pixels, the scan lines $SL_1$ to $SL_n$ are simultaneously driven by the field sequential display. This is done in order to avoid the pixel data written in the pixels in the red field from conflicting with display of the next field (e.g. herein the green field). It should be noted that period T11 can be equal to period T12, and period T13 can be shorter than period T11 and period T12.

In the green field and the blue field of the first frame, green LEDs and blue LEDs are lit to provide green and blue backlights. The driving schemes of scan lines $SL_1$ to $SL_n$ in the green and blue fields are the same as those in the red field of the first frame. In other words, the driving schemes in period T21 and period T31 can refer to the descriptions of period T11, and the driving schemes in period T22 and period T32 can refer to the descriptions of T12, and the driving schemes in period T23 and period T33 can refer to the descriptions of T12. Nonetheless, in different color fields, the time of driving the scan lines $SL_1$ to $SL_n$ can be different. Therefore, the brightness displayed by the red, green, and blue fields of the first frame is more uniform. In addition, the increase in driving speed results in a reduction of image flickers since the human vision is less exposed to flickering images.

Referring to the second frame, in the second frame there are also a red, green, and blue field. However, in the red field of the second frame, a reverse scan is realized before the forward scan. In other words, during period T41 (or the fourth period), the field sequential display apparatus sequentially drives the scan lines $SL_n$ to $SL_1$ according to the opposite sequence, writes pixel data into the corresponding pixels, and allows the image to be displayed in the red field region. During period T42 (or the fifth period), the field sequential display apparatus sequentially drives the scan lines $SL_1$ to $SL_n$ according to the scanning sequence, writes pixel data into the corresponding pixels, and allows the image to be displayed in the red field again.

Similarly, because the scan lines $SL_n$ to $SL_1$ are sequentially scanned in period T41 whereas the scan lines $SL_1$ to $SL_n$ are sequentially driven in period T42, there are discrepancies between the brighter and darker displayed regions of the red field. Hence, the displayed brightness of the red field in periods T41 and T42 is more uniform. During period T43 (or the sixth period), in order to write the reset pixel data into all of the pixels, the scan lines $SL_1$ to $SL_n$ are simultaneously driven by the field sequential display apparatus. This is done in order to avoid conflicts between the pixel data written in the pixels in the red field and the display of the green field.

In the green field and the blue field of the second frame, the driving schemes of the scan lines $SL_1$ to $SL_n$ are the same as the driving scheme in the red field of the second frame. In other words, the driving schemes of period T51 and period T61 can refer to the descriptions of period T41, and the driving schemes of period T52 and period T62 can refer to the descriptions of T42, and the driving schemes of period T53 and period T63 can refer to the descriptions of T43. Therefore, the brightness displayed by the red, green, and blue fields of the second frame is more uniform. In addition, the increase in driving speed results in the reduction of image flickers since human vision is exposed less to flickering images.

In view of the foregoing, because dissimilar scanning schemes are used for each of the fields in the first and second frames, there are discrepancies between the displayed image from the first frame and the displayed image from the second frame, where the discrepancies occur at the brighter and darker regions of the displayed image. Therefore, after overlapping the displayed images from the first and second frames, there will be increased uniformity of image brightness for the field sequential display apparatus. Additionally, only one reset cycle appears in each of the fields of the first and second frames. Hence, the driving time of each scan line can be made longer than conventional driving time, and thus the problem of insufficient time for accurate pixel data writing is avoided. It is worth noting that the aforementioned first frame and second frame can be an odd frame or an even frame, respectively. That is, those with ordinary skill in the art should provide the setting, and the present invention is not limited thereto. In addition, for traditional liquid crystal displays during pixel resets, there is a voltage difference between an upper electrode plate and a lower electrode plate of each of the pixels. Consequently, during periods T13, T23, T33, T43, T53, and T63, by setting the voltage difference between the upper electrode plate and the lower electrode plate of each of the pixels to zero, the uniformity of the displayed image is further enhanced.

Figure 3:
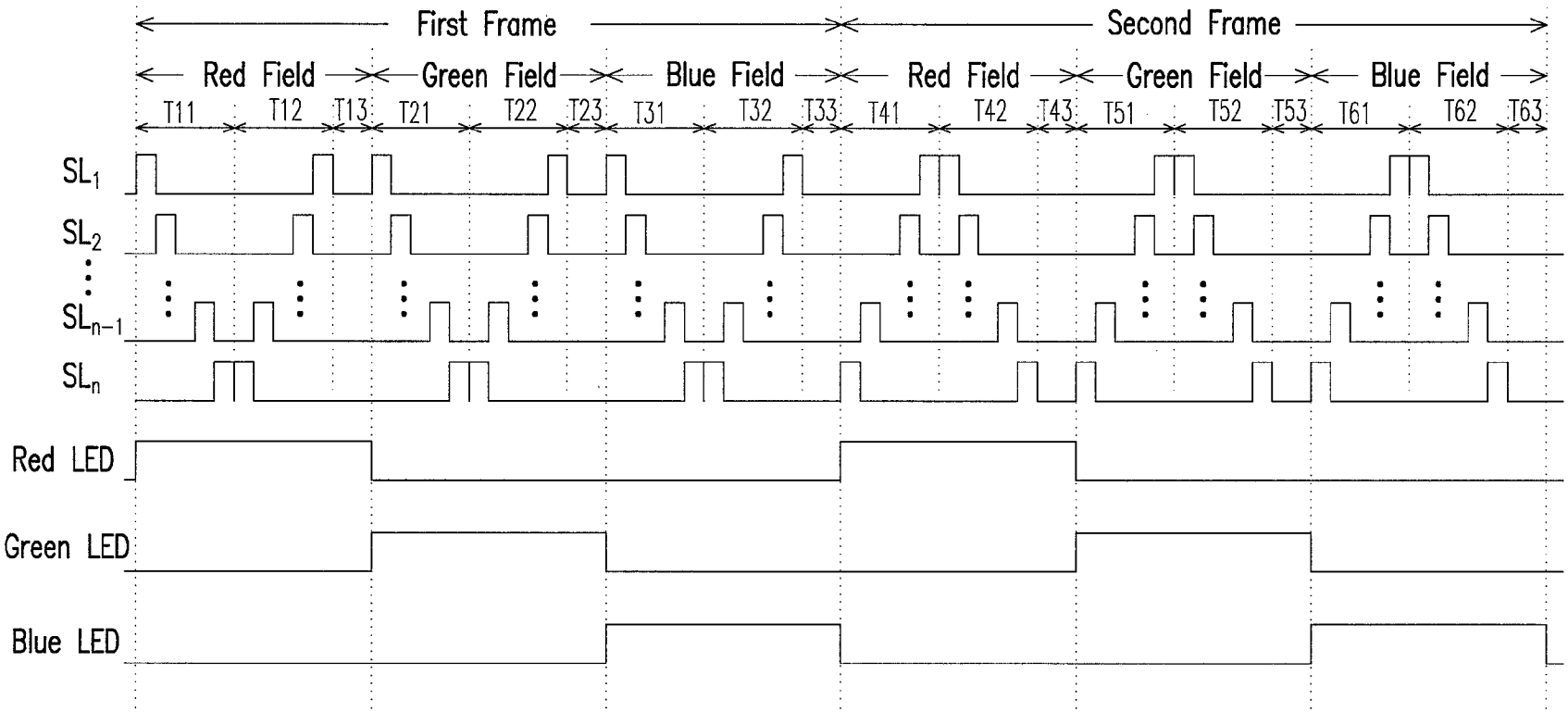
FIG. 3 is a schematic view illustrating the driving waveform of a field sequential display apparatus according to another embodiment of the present invention.

FIG. 3 is a schematic view illustrating the driving waveform of a field sequential display apparatus according to another embodiment of the present invention. As shown in FIG. 2 and FIG. 3, the dissimilarities there between are the termination of the driving of the scan lines $SL_1$ to $SL_n$ at the periods T13, T23, T33, T43, T53, and T63. Herein, the liquid crystals are set to auto-recover to their normal states (e.g. a splay state).

Figure 4:
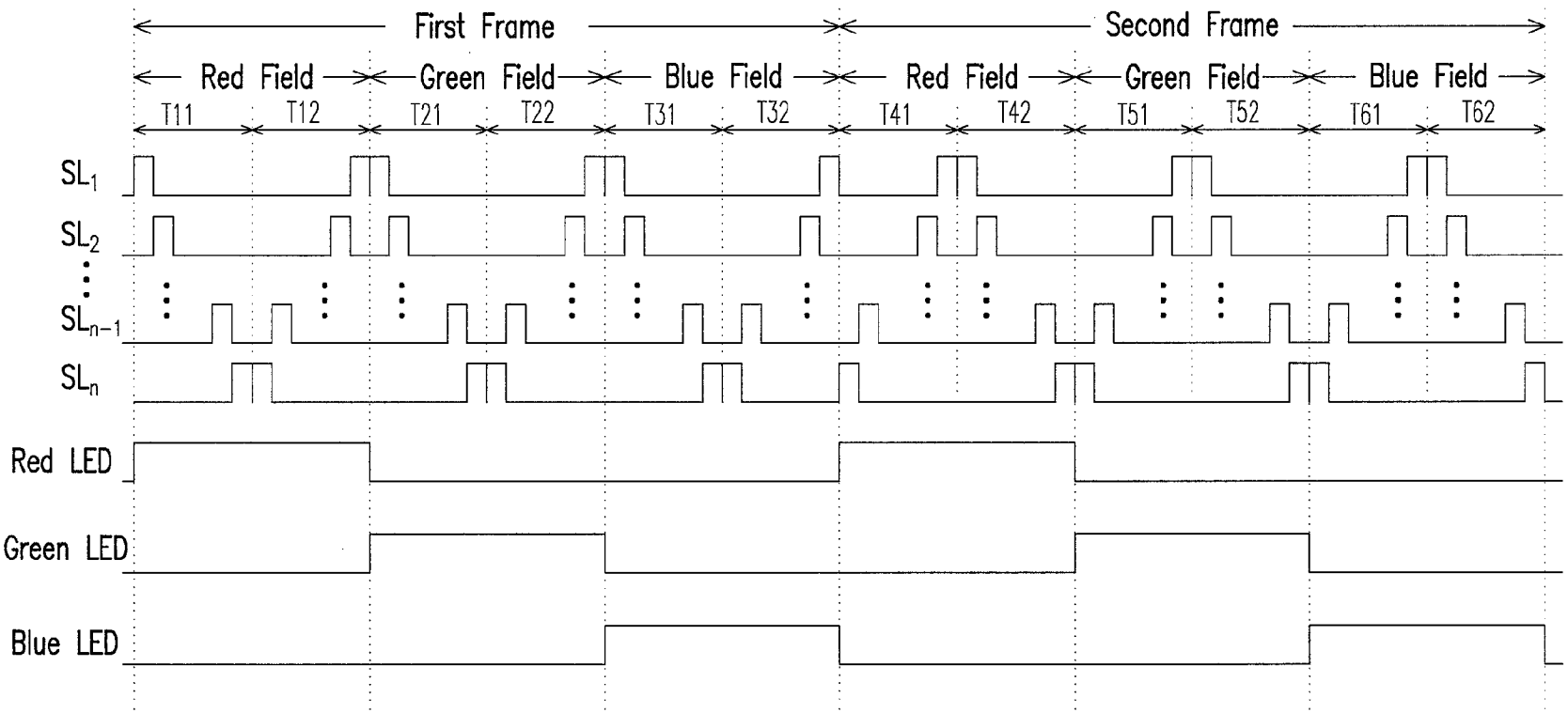
FIG. 4 is a schematic view illustrating the driving waveform of a field sequential display apparatus according to another embodiment of the present invention.

Nonetheless, the time of periods T13, T23, T33, T43, T53, and T63 can be decreased, even to zero. FIG. 4 is a schematic view illustrating the driving waveform of a field sequential display apparatus according another embodiment of the present invention. As shown in FIG. 3 and FIG. 4, the dissimilarities are that periods T13, T23, T33, T43, T53, and T63 are set to zero, or that in the present embodiment of the invention, there are no periods T13, T23, T33, T43, T53, and T63. In the first frame, because the driving sequence of each field is connected head and tail, the first driven scan line and the last driven scan line of each field is the same scan line. Therefore, the pixel that has the last write-in pixel data of the previous field is the first pixel to be updated in the current field. Hence, pixel data from each field do not conflict across fields. Similarly, during the second frame, the write-in pixel data from each field do not conflict across fields.

When switching occurs between the first frame and the second frame, the last driven scan line in the blue field of the first frame is $SL_1$, and the first driven scan line in the blue field of the second frame is $SL_n$. Therefore, there is some influence on the displayed image. Nonetheless, because liquid crystals take time to rotate, there is some time needed after pixel data are written before pixels of the scan lines $SL_n$ are stable. Meanwhile, pixels of the scan line $SL_1$ simultaneously restore themselves. Therefore, when pixel data from pixels of the scan line $SL_n$ are stabilized, the pixels on the scan line $SL_1$ are substantially restored to their normal state. Hence, even if there are no periods T13, T23, T33, T43, T53, and T63, normal vision effects are still achieved.

In summary, in the method of driving a field sequential display apparatus in the present invention, pixel data is written into each pixel by sequentially driving the scan lines of each of the fields according to the scanning sequence or the opposite sequence, wherein the opposite sequence is in the reverse order of the scanning sequence. Consequently, the uniformity of image brightness is improved for each of the fields. In addition, because the driving schemes of the scan lines for each of the odd frames is reversed with those of the even frames, the field sequential display apparatus of the present invention has enhanced uniformity of image brightness. Additionally, since driving speed is increased and human vision detects less image flickers, therefore image flickering is reduced.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A method of driving a field sequential display apparatus, the method comprising:

sequentially driving a plurality of scan lines of the field sequential display apparatus during a first period of a first field, wherein the scan lines are sequentially driven according to a scanning sequence, and the first field is within a first frame;

driving the scan lines sequentially during a second period of the first field, wherein the scan lines are sequentially driven according to an opposite sequence, and the opposite sequence is in the reverse order of the scanning sequence; and driving the scan lines simultaneously during a third period of the first field.

2. The method of driving the field sequential display apparatus as claimed in claim 1, further comprising:

driving the scan lines sequentially during a fourth period of a second field, wherein the scan lines are sequentially driven according to the opposite sequence, and the second field is within a second frame;

driving the scan lines sequentially during a fifth period of the second field, wherein the scan lines are sequentially driven according to the scanning sequence; and driving the scan lines simultaneously during a sixth period of the second field.

3. The method of driving the field sequential display apparatus as claimed in claim 2, wherein the first field and the second field are a red field, a green field, or a blue field.

4. The method of driving the field sequential display apparatus as claimed in claim 2, wherein the first frame and the second frame are respectively an odd frame and an even frame.

5. The method of driving the field sequential display apparatus as claimed in claim 2, wherein the scan lines correspond to a plurality of pixels, and during the third period and during the sixth period, there is zero voltage difference between an upper electrode plate and a lower electrode plate of each of the pixels.

6. The method of driving the field sequential display apparatus as claimed in claim 1, wherein the first period and the second period are equivalent.

7. The method of driving the field sequential display apparatus as claimed in claim 1, wherein within the first field, the time of driving each of the scan lines is equivalent.

8. A method of driving a field sequential display apparatus, comprising:

sequentially driving a plurality of scan lines of the field sequential display apparatus during a first period of a first field, wherein the scan lines are sequentially driven according to a scanning sequence, and the first field is within a first frame;

driving the scan lines sequentially during a second period of the first field, wherein the scan lines are sequentially driven according to an opposite sequence, and the opposite sequence is in the reverse order of the scanning sequence; and terminating the driving of the scan lines during a third period of the first field.

9. The method of driving the field sequential display apparatus as claimed in claim 8, further comprising:

driving the scan lines sequentially during a fourth period of the second field, wherein the scan lines are sequentially driven according to the opposite sequence, and the second field is within a second frame;

driving the scan lines sequentially during a fifth period of the second field, wherein the scan lines are sequentially driven according to the scanning sequence; and terminating the driving of the scan lines during a sixth period of the second field.

10. The method of driving the field sequential display apparatus as claimed in claim 9, wherein the first field and the second field are a red field, a green field, or a blue field.

11. The method of driving the field sequential display apparatus as claimed in claim 9, wherein the first frame and the second frame are respectively an odd frame and an even frame.

12. The method of driving the field sequential display apparatus as claimed in claim 9, wherein the time of the sixth period is zero.

13. The method of driving the field sequential display apparatus as claimed in claim 9, wherein the scan lines correspond to a plurality of pixels, wherein during the third period and during the sixth period, there is zero voltage difference between an upper electrode plate and a lower electrode plate of each of the pixels.

14. The method of driving the field sequential display apparatus as claimed in claim 8, wherein the first period and the second period are equivalent.

15. The method of driving the field sequential display apparatus as claimed in claim 8, wherein within the first field, the time of driving each of the scan lines is equivalent.

16. The method of driving the field sequential display apparatus as claimed in claim 8, wherein the time of the third period is zero.

* * * * *